United States Patent [19]

Gilchrist

[11] 4,434,524

[45] Mar. 6, 1984

[54] MAGNETIC DOOR HARDWARE

[75] Inventor: Henry R. Gilchrist, Burlington, Mass.

[73] Assignee: Eckel Industries, Inc., Cambridge, Mass.

[21] Appl. No.: 370,113

[22] Filed: Apr. 20, 1982

[51] Int. Cl.[3] ..... E05D 11/00; E05D 11/10; E05F 1/14

[52] U.S. Cl. ..... 16/250; 16/280; 16/320; 16/DIG. 14; 49/386; 292/251.5; 403/120; 403/DIG. 1

[58] Field of Search ..... 16/71, 223, 250, 280, 16/320, 386, DIG. 14; 292/251.5; 49/379, 386, 388; 403/120, 165, DIG. 1

[56] References Cited

U.S. PATENT DOCUMENTS

| | | | |
|---|---|---|---|
| 1,873,534 | 8/1932 | Brethen | 16/386 |
| 3,477,176 | 11/1969 | Tansley | 49/379 X |
| 3,730,577 | 5/1973 | Shanok et al. | 292/251.5 |

FOREIGN PATENT DOCUMENTS

| | | | |
|---|---|---|---|
| 2470226 | 6/1981 | France | 292/251.5 |
| 1530591 | 11/1978 | United Kingdom | 292/251.5 |

*Primary Examiner*—Fred A. Silverberg
*Attorney, Agent, or Firm*—Schiller & Pandiscio

[57] ABSTRACT

Magnetic door hardware for closing swinging doors. Two magnets are axially aligned with the door post, and the magnetic fields of the magnets are aligned so as to produce a radial torque when the door is swung open. One magnet is attached to the door post, and the other magnet is attached to the door frame so that the radial torque produced by the magnets causes the door to rotate to the closed position.

10 Claims, 6 Drawing Figures

MAGNETIC DOOR HARDWARE

This invention relates to improvements in door hardware utilizing magnetic components. More particularly, it relates to magnetic hardware for causing a swinging door to close after the door has been manually swung open.

PRIOR ART

The use of magnets to help keep doors closed is well known. Magnetic components of this type are usually located in the frame of the door (normally near a portion of the door away from the door hinges) and in the door itself so that after the door closes, the force of two attracting magnets assists in maintaining the door in its closed position. The magnets may be either permanent magnets or electromagnets.

Examples of this type of magnetic door keeper are found in U.S. Pat. Nos. 4,115,576, 3,730,577, and 3,184,803, and in the references cited therein.

The major problem with door keepers of the type described is that the magnets are not installed in the proper locations relative to the door for the purpose of returning the door to its originally closed position after the door has been opened; rather, these prior art magnetic door keepers rely on some other means to close the door so that the installed magnets function only to assist in maintaining the door in the closed position.

Some prior art door checks use a magnet and a soft ferromagnetic material, e.g. iron or soft steel, to produce a retarding drag on the closing motion of a door. This type of magnetic door check is exemplified by U.S. Pat. No. 1,701,202. As with the prior art magnetic door keepers described above, one problem with prior art magnetic door checks of this type is that they rely on some other primary means for closing the door, e.g., a door return spring. The door check functions to retard this primary closing means so as to minimize problems with slamming and banging of the door when it is closed, but does not itself provide any motive force for closing the door. Another problem with this type of door check is its complexity. The ferromagnetic material is normally embodied in an arcuate armature spaced a small distances away from a moving edge of the door, while an electromagnet is correspondingly located near the same moving door edge. The manufacture and installation of such an armature and electromagnet requires considerable time and precise effort. Apparatus to deenergize the electromagnet when the door is closed, and/or while the door is in the process of opening, requires further complexity in the form of contact bars, limit switches, and the like. Door checks of this type are costly and highly susceptible to malfunctions caused by bumping and subsequent misalignment of the armature. The problems are especially acute in the case of resilient doors of the type discussed in U.S. Pat. Nos. 3,979,872, 3,353,857, 3,325,943, 3,146,827, and 3,146,826, which are commonly used in warehouses and are frequently impacted by vehicles entering or leaving the warehouses.

OBJECTS OF THE INVENTION

Accordingly, the primary object of this invention is to provide improved magnetic door hardware that eliminates, or substantially reduces, the problems noted above and is useful in connection with flexible swinging doors.

Another object is to provide magnetic door hardware that will function to close a swinging door after it has been swung open, as well as assist in maintaining the door in its closed position after it has closed.

A further object is to provide improved magnetic door hardware that will achieve the objects listed above at a relatively low cost and utilize a relatively simple design that will result in fewer and simpler maintenance and repair requirements than exists with presently available hardware for doors.

SUMMARY OF THE INVENTION

Attainment of the goals listed above is achieved by improved magnetic hardware for doors that essentially comprise two magnets that provide a force for closing a swinging door, mounted on one or more posts, an upper magnet holder and a lower magnet holder which are aligned with the door post(s) so as to maintain predetermined relative positions of the two magnets and the door post(s), and means for measuring and adjusting the relative positions of the magnets.

In the preferred embodiment of the invention, the magnets have short cylindrical configurations. These magnets are axially aligned with the door post, preferably above the post. One of the magnets is connected to the door frame header, and the other magnet is attached to the door post. Each magnet is positioned so that its poles are in a predetermined alignment with the poles of the other magnet, so that their magnetic fields interact to produce a radial torque that urges the door toward its closed position. Modifications of the invention allow for other magnet configurations that provide similarly interacting magnetic fields that cause the door to move toward the closed position.

THE DRAWINGS

Figure 1:
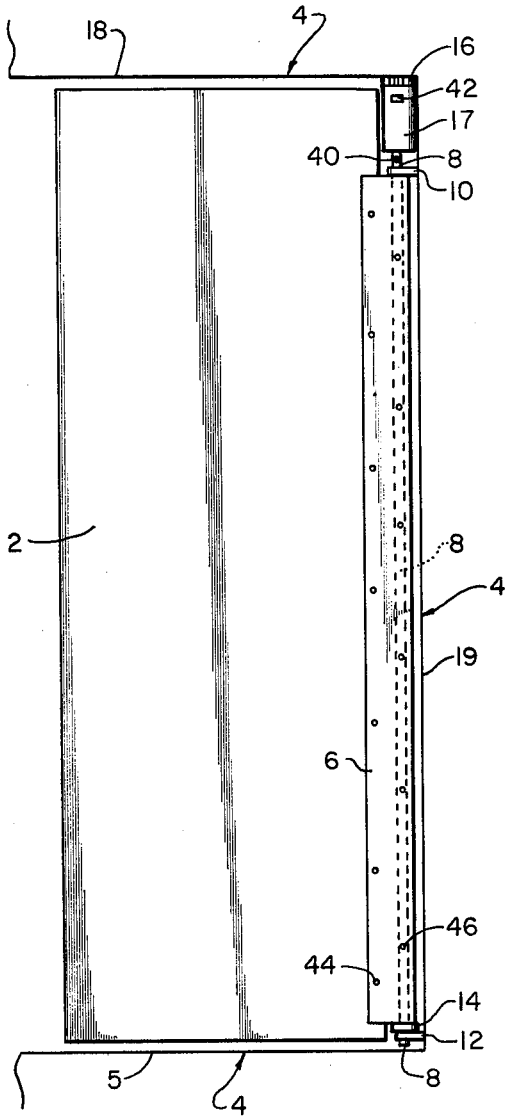
FIG. 1 is a front view in elevation of a swinging door having magnetic door hardware according to the present invention.

Turning first to FIG. 1, the illustrated apparatus comprises a swinging door 2 having magnetic door hardware constructed in accordance with this invention. A door frame 4 surrounds the periphery of door 2 and comprises a header 18 and a side jamb 19. The side of door 2 opposite side jamb 19 may be enclosed by either a second side jamb (not shown) or the outside edge of a second door (not shown). A floor 5 normally borders the bottom of door 2. Door 2 is connected to side jamb 19 by a door mounting attachment 6, a door mounting post 8, and upper and lower post bearings 10 and 12. A thrust bearing 14 is positioned around post 8 between lower bearing 12 and the bottom of door mounting attachment 6. The magnetic door hardware of the invention is mounted above the door mounting post 8. An upper magnet holder 16 is mounted to header 18 of door frame 4.

Figure 2:
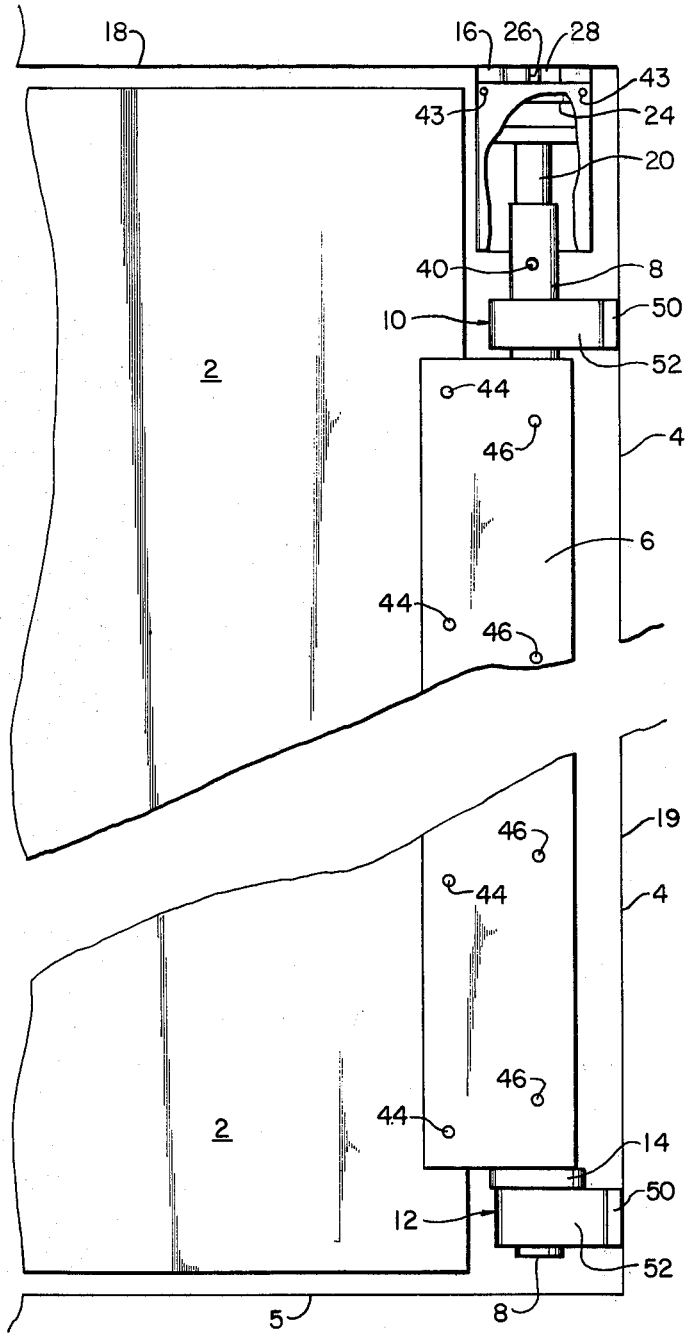
FIG. 2 is an enlarged fragmentary view of the upper and lower hinged corners of the door in FIG. 1, the drawing also showing an enlarged partial cutaway view of the magnetic door hardware.
Figure 3:
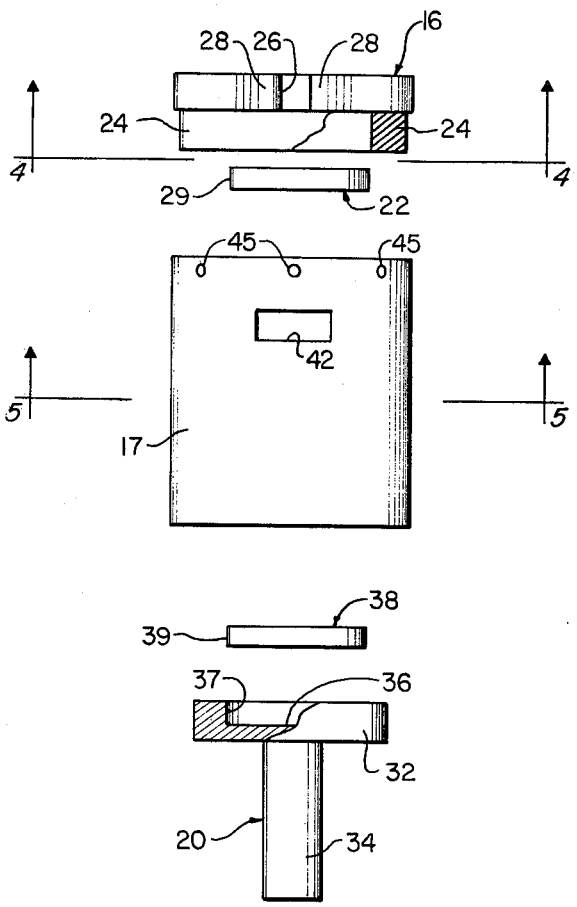
FIG. 3 is an enlarged and exploded view in side elevation of the magnetic door hardware of the invention, with certain portions shown in section.
Figure 4:
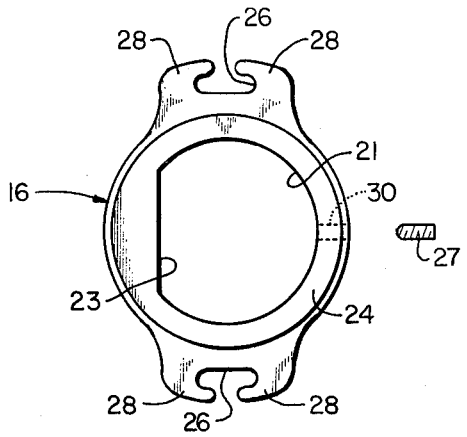
FIG. 4 is a bottom plan view of the upper magnet holder taken along line 4—4 of FIG. 3.
Figure 5:
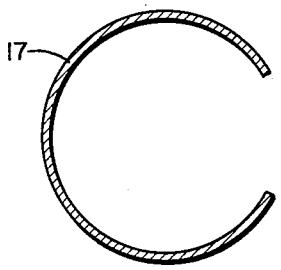
FIG. 5 is a sectional view of the outer cover taken along line 5—5 of FIG. 3.

Turning now to FIGS. 2, 3, and 4, upper magnet holder 16 has a cylindrical configuration. The bottom side of holder 16 has an integrally attached annular collar 24 extending downward. The inner surface of collar 24 defines a depression 21 (see FIG. 4) that houses an upper magnet 22. Collar 24 has a cross-sectional configuration that is substantially circular except for a flat 23 that is defined by a relatively short chord (see FIG. 4) and that effectively reduces the cross-sectional area of depression 21. Flat 23 extends along the entire vertical length of collar 24. A set screw 27 (FIG. 4) screws into a horizontal hole 30 (FIG. 4) passing through the side of collar 24. Upper holder 16 is mounted to the header 18 by bolts (not shown) placed through elongated openings 26 in two ears 28 integrally attached to the upper end of holder 16. Upper magnet 22 (FIG. 3) has a short cylindrical configuration with a diameter substantially the same as the inner diameter of annular collar 24 so that upper magnet 22 makes a snug fit in collar 24. Magnet 22 also has a recessed flat 29 (FIG. 3) in its side which must be radially aligned with flat 23 in collar 24 in order for magnet 22 to slide into depression 21. Flats 23 and 29 coact to prevent rotation of upper magnet 22 relative to upper magnet holder 16.

As seen in FIG. 3, a lower magnet holder 20 comprises a disk-shaped head 32 and an elongate cylindrical rod 34 integrally attached to and projecting downward from the bottom end of head 32. Head 32 has a circular depression 36 in its upper end to accommodate a lower magnet 38. Depression 36 has a flat 37 similar to the flat 23 in depression 21 (FIG. 4). Lower magnet 38 has a recessed flat 39 in its side that is sized to allow lower magnet 38 to make a snug slidable fit in depression 36 when flats 37 and 39 have been radially aligned. The mating flats 37 and 39 prevent rotation of magnet 38 relative to lower magnet holder 20. Rod 34 makes a rotatable and slidable fit in a bore 9 through the center of the upper end of post 8. A set screw 40 (FIG. 2) is screwed into a hole in the upper side of post 8 so as to hold rod 34 in place after the rod has been inserted into bore 9 as far as desired. When screw 40 is loosened, rod 34 can be rotated as desired; but when the screw is tightened, rod 34 is fixed in position, both radially and axially.

Upper magnet 22 and lower magnet 38 have magnetic fields that are oriented horizontally. These permanent magnets may be composed of Alnico alloys or from cobalt-rare earth alloys, e.g., cobalt-samarium, depending on the size of the door 2 and the corresponding radial torque required to close a door of that size. For a given size magnet 22 or 38, a cobalt-rare earth material would provide the greatest magnetic induction. Both magnets 22 and 38 are magnetically polarized transversely through their diameters so that their north and south magnetic poles are positioned at the outer surface of the sides of magnets 22 and 38. The north and south poles (not shown) of each magnet lie in a horizontal plane and are diametrically opposed to each other. In the preferred embodiment of the invention, magnets 22 and 38 are held in a predetermined radial alignment by magnet holders 16 and 20, respectively, so that their magnetic fields coact to close door 2 when the door has been swung open. This predetermined alignment exists when the following two conditions simultaneously exist: (1) the north pole of the magnet 22 is directly above and radially aligned with the south pole of magnet 38 (so that the south pole of magnet 22 is also above and radially aligned with the north pole of magnet 38), and (2) the door 2 is at rest in the closed position.

Turning now to FIGS. 1, 2, 3, and 5, an outer cover 17 surrounds lower magnet holder 20 and is connected to upper magnet holder 16 by set screws 43 (FIG. 2) that penetrate the upper side of cover 17 through holes 45 (FIG. 3) and make a tight fit against collar 24 when screwed inward. Outer cover 17 has a C-shaped cross-section (see FIG. 5) that allows cover 17 to be removed from around lower magnet holder 20 by loosening set screws 43, lowering cover 17 below head 32 of holder 20, and pulling cover 17 outward from around post 8 and shaft 34 of holder 20. An adjustment slot 42 in the upper side of outer cover 17 (FIGS. 1 and 3) has a substantially rectangular shape and is large enough to allow a person to check the relative axial positions of magnets 22 and 38 by inserting a measuring instrument, e.g., a "feeler" gauge, that will accurately measure the vertical gap between the magnets.

Figure 6:
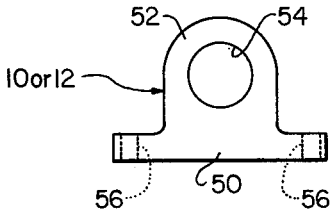
FIG. 6 is a top plan view of a door post bearing.

Turning now to FIGS. 1, 2, and 6, the swinging door 2 is mounted to side jamb 19 by the door mounting attachment 6 and post bearings 10 and 12. One side of attachment 6 is securely fastened to the door 2 by screws 44 or any other suitable fasteners. The opposite side of attachment 6 is similarly attached to the door mounting post 8 using fasteners 46 such as screws or the like. Door post 8 is rotatably mounted in upper and lower post bearings 10 and 12, which are securely attached to the side jamb 19 by screws or some other suitable fasteners (not shown). As seen in FIG. 6, each post bearing 10 or 12 comprises a rectangular mounting plate 50 and an integrally attached collar 52 that projects from one side of the mounting plate 50. Collar 52 has a vertical bore 54. Two smaller diameter horizontal holes 56 penetrate plate 50 near its outside edges. Door mounting post 8 makes a snug rotatable fit in bore 54 of upper and lower post bearings 10 and 12. Thrust bearing 14 has a short cylindrical shape and has a bore (not shown) through its center to accommodate door post 8.

A description of the operation of the magnetic door hardware follows. Swinging door 2 is connected to door mounting post 8 by door mounting attachment 6. Door 2 can swing open in both directions, i.e., either inward or outward. Thrust bearing 14 is positioned between mounting attachment 6 and lower post bearing 12 in order to help support the weight of the door 2 and to facilitate smooth rotation of door 2 with minimal resistance by withstanding the downward axial thrust of door 2 as it rotates.

When door 2 is at rest in the closed position, each magnet 22 and 38 has its north and south magnetic poles lying in a horizontal plane, with the two poles located diametrically opposite each other; also, magnets 22 and 38 are positioned relative to each other in a predetermined radial alignment, as described above, so that the north pole of one magnet is radially aligned with the south pole of the other magnet, i.e., magnetic poles of opposite polarity are radially aligned with each other. This results in a mutual attractive force between the magnets which tends to hold both magnets motionless with respect to each other, i.e., no radial torque results when the magnets are in this position and the door 2 is at rest in the closed position.

When the door 2 is swung open in either direction, lower magnet 38 is rotated by lower holder 20 (which is nonrotatably connected to door mounting post 8) so that the north pole of magnet 38 rotates toward the radial position below the north pole of upper magnet 22, while the south poles of both magnets also move closer together radially. Since like magnetic poles repel each other, the opening of door 2 causes magnets 22 and 38 to produce a repelling force—the farther door 2 is rotated open, the closer the like poles of magnets 22 and 38 get, and the greater the resulting radial torque.

Thus, as door 2 swings back and forth through its closed position, the symmetrical magnetic fields of magnets 22 and 38 produce a radial torque that gets greater as the door swings farther from the closed position. Since door 2 loses energy (e.g., through friction losses) each time it swings through the closed position, a smaller radial torque is required to force the door toward its closed position after each swing cycle, so that door 2 eventually comes to rest in its original closed position.

The amount of radial torque generated by the magnets 22 and 38 varies according to (a) the radial distance that door 2 is rotated, (b) the magnitude of the magnetic induction of magnets 22 and 38, and (c) tthe axial separation between magnets 22 and 38. The present invention includes means for adjusting the axial displacement of magnets 22 and 38. Adjustment slot 42 provides an opening for an instrument that can measure the axial displacement, e.g. a "feeler" gauge, whereby the instrument can be inserted through cover 17 into the vertical gap between magnets 22 and 38. If the measurement results indicate that the magnets are too close together or too far apart, set screw 40 can be loosened in order to adjust the height of lower magnet holder 20, thereby adjusting the vertical gap between magnets 22 and 38 as desired. Set screw 40 is then retightened to hold lower magnet holder 20 firmly in place.

The invention illustrated and described above has a number of advantages. First of all, the magnetic door hardware provides the force necessary to close a door, i.e., the radial torque generated by the magnets, rather than merely providing means for maintaining a door in the closed position after it has been closed, or slowing down the closing action of a door caused by some other door closing force.

Secondly, the magnetic door hardware is simple, relatively inexpensive, and needs very little maintenance or repair due to the simple design. The vertical gap between the magnets can easily be checked periodically by using the adjustment slot 42, and if any adjustment is required, set screw 40 can be loosened to allow a simple adjustment of the elevation of lower magnet holder 20.

Another advantage is the use of outer cover 17 to keep out most of the grit and grime in the vicinity of the magnetic door hardware. Cover 17 can easily be removed to provide access to upper and lower magnet holders 16 and 20. Preferably, the magnetic door hardware is axially aligned with the door mounting post 8 above the post, rather than below the post, in order to minimize the amount of grit and grime present in the vicinity of the magnetic door hardware.

Outer cover 17 and magnet holders 16 and 20 are made of a non-ferromagnetic material such as aluminum in order to limit the magnetic induction in the volume immediately surrounding magnets 22 and 38.

The invention also has the advantage that it is susceptible of various changes. One possible modification to the present invention is to replace the magnet configuration of the preferred embodiment, i.e., two disk-shaped magnets polarized transversely through their diameters and facing each other, with other configurations. One possible modified configuration of the magnets is one magnet, having a solid cylindrical shape, loosely fitting inside a second magnet that is cylindrical and hollow. The magnetic fields of these telescoping magnets, as in the preferred embodiment, would be oriented so as to produce a radial torque on the door mounting post 8 in a manner similar to that described above. Other possible magnet configurations may be used also. In addition, the permanent magnets 22 and 38 may be replaced by electromagnets having magnetic fields aligned in a predetermined manner, as described above for magnets 22 and 38.

Another possible modification to the present invention is to attach a mechanical stop to the door frame 4 so that the door 2 can open in only one direction. Thus when the magnets 22 and 38 force door 2 toward its closed position, as described above, the door 2 will immediately come to rest in the closed position (when it makes contact with the mechanical stop) instead of swinging back and forth through the closed position as in the description of the preferred embodiment.

Still another possible modification is to rotatably attach the door 2 to a door mounting post 8 that is nonrotatably connected to the side jamb 19. This modification would require that lower magnet holder 20 be connected directly to door 2 in order to cause the door to rotate about the fixed post 8.

A further possible modification of the present invention is the addition of means for holding the door 2 in the closed position. Such means could be mechanical or magnetic. An example of mechanical means is a snubber apparatus as disclosed in U.S. Pat. No. 3,353,857 to Mongor. Basically, the snubber apparatus provides a mechanical detent for the door 2. The door can be opened in either direction by exerting a force against the door sufficient to dislodge the door from the snubber apparatus. In addition, such a mechanical apparatus would provide means for preventing door 2 from swinging back and forth when magnets 22 and 38 cause door 2 to close. An example of magnetic means for holding door 2 closed is an arrangement where a magnet in the door frame 4 (preferably somewhere other than side jamb 19) coacts with an adjacent magnet in the outer edge of door 2 to keep door 2 in the closed position. Again, these magnets could also provide sufficient retarding force to minimize the swinging action of door 2 when magnets 22 and 38 cause door 2 to close.

A still further possible modification is to mount door 2 on a multiplicity of axially-aligned mounting posts 8 rather than on a single post 8 as described for the preferred embodiment. For example, the post 8 in the preferred embodiment of the invention could be divided into two posts, each being support in post bearings similar to bearings 10 and 12.

Other modifications and advantages of the invention will be obvious to persons skilled in the art.

What is claimed is:

1. Magnetic door hardware for a swinging door, said hardware comprising in combination:

a door mounting post to which one side of said door is affixed, said post having an upper end and a lower end;

a door frame around the periphery of said door, said frame comprising at least a header member above said door and a vertical side jamb member parallel to and adjacent said one side of said door affixed to said door mounting post;

means for rotatably connecting said post to said side jamb member so as to allow said door to rotate to the open or closed position; and magnetic means for urging said door to rotate from open position back to closed position;

said magnetic means comprising a first permanent magnet attached to one end of said door post so as to rotate therewith; a second permanent magnet affixed to said door frame so as to be aligned with and adjacent said first magnet; and a first magnetic field, associated with said first magnet, interacting with a second magnetic field associated with said second magnet, so that when said first magnet rotates relative to said second magnet, a radial torque results that urges said door to rotate to the closed position.

2. Hardware according to claim 1, further comprising means for adjusting the axial position of said first magnet so as to allow the vertical gap between said first and second magnets to be adjusted by varying the distance said first magnet extends upward from said one end of said door post.

3. Hardware according to claim 1, wherein said first magnet is attached to said upper end of said door post, and said second magnet is affixed to said header member so as to be axially aligned with said first magnet.

4. Hardware according to claim 1, further comprising a hollow cylindrical outer cover surrounding said first and second magnets so as to limit introduction of dust and foreign matter into the space immediately surrounding said first and second magnets.

5. Hardware according to claim 2 or claim 4, wherein said outer cover has an aperture in its side to allow measurement of said vertical gap between said first and second magnets, said magnetic door hardware further comprising means for removing said outer cover from around said first and second magnets without moving said first and second magnets.

6. Hardware according to claim 5, wherein said removal means comprise an outer cover having a portion of its arc removed, said portion including the entire length of said outer cover and being wide enough to allow said door mounting post to easily pass through said portion.

7. Magnetic door hardware for a swinging door, said hardware comprising in combination:

a door frame around the periphery of said door, said frame comprising at least a header member above said door and a vertical side jamb member parallel to the longitudinal axis of said door;

a door mounting post mounted to said side jamb member;

means for connecting said door to said mounting post so as to allow said door to rotate to an open or closed position; and magnetic means for urging said door to rotate from open position back to closed position, said magnetic means comprising in combination a first permanent magnet attached to said header member in alignment with said door mounting post, and a second permanent magnet connected to said door and positioned so as to be in alignment with said first magnet, said first and second magnets having first and second magnetic fields respectively interacting with one another so that when said second magnet rotates relative to said first magnet, said first and second magnetic fields produce a torque that urges said door to rotate to the closed position.

8. Hardware according to claim 7, further comprising means for adjusting the axial position of said second magnet so as to allow the vertical gap separation between said first and second magnets to be varied.

9. Hardware according to claim 8, further comprising in combination:

a hollow cylindrical outer cover surrounding said first and second magnets, said outer cover having an aperture in its side to allow measurement of said vertical gap between said first and second magnets; and means for removing said outer cover from around said first and second magnets.

10. Hardware according to claim 1 or claim 7 wherein said door mounting post is replaced by a multiplicity of axially aligned door mounting posts, including a top post having an upper end and a bottom post having a lower end.

* * * * *